United States Patent [19]

Wong et al.

[11] Patent Number: 4,980,693

[45] Date of Patent: Dec. 25, 1990

[54] FOCAL PLANE ARRAY ANTENNA

[75] Inventors: Mon N. Wong, Torrance; Robert J. Patin, Hawthorne; Donald C. D. Chang, Thousand Oaks, all of Calif.

[73] Assignee: Hughes Aircraft Company, Los Angeles, Calif.

[21] Appl. No.: 317,882

[22] Filed: Mar. 2, 1989

[51] Int. Cl.[5] ..... H01Q 1/380; H01Q 13/080

[52] U.S. Cl. ..... 343/700; 343/846

[58] Field of Search ..... 343/700 MS, 846

[56] References Cited

U.S. PATENT DOCUMENTS

| | | | |
|---|---|---|---|
| 4,326,203 | 4/1982 | Kaloi | 343/700 MS |
| 4,410,891 | 10/1983 | Schaubert et al. | 343/700 MS |
| 4,500,887 | 2/1985 | Nester | 343/700 MS |
| 4,675,685 | 6/1987 | Finken | 343/708 |
| 4,740,793 | 4/1988 | Wolfson et al. | 343/700 MS |
| 4,749,996 | 6/1988 | Tresselt | 343/700 MS |
| 4,761,654 | 8/1988 | Zaghloul | 343/700 MS |
| 4,800,392 | 1/1989 | Garay et al. | 343/700 MS |
| 4,835,538 | 5/1989 | McKenna et al. | 343/700 MS |
| 4,843,400 | 6/1989 | Tsao et al. | 343/700 MS |

FOREIGN PATENT DOCUMENTS

| | | | |
|---|---|---|---|
| 0207703 | 11/1984 | Japan | 343/700 MS |
| 2046530 | 11/1980 | United Kingdom | 343/700 MS |

OTHER PUBLICATIONS

Analysis of a Suspended Patch Antenna . . . IEEE Trans on Ant. & Prop., vol. AP 33, No. 8, Aug. 85, pp. 895–899.

Hall, New Wideband Microstrip, Ant. Using Log-Periodic Technique Electronics Letter, Feb. 1980, vol. 16, No. 4, pp. 127–128.

R. J. Mailloux, "Phased Array Architecture for mm-Wave Arrays," *Technical Feature,* Jul. 1986, pp.117–124.

Q. Zhang et al. "Analysis of a Suspended Patch Antenna Excited by an Electromagnetically Coupled Inverted Microstrip Feed," Department of Electrical Engineering, The University of Texas, pp. 1–4.

R. C. Johnson et al., "Microstrip-Antenna-Element Design Parameters," *Antenna Engineering Handbook,* 2nd Edition, pp. 7-2–7-27.

*Primary Examiner*—Rolf Hille
*Assistant Examiner*—Peter Toby Brown
*Attorney, Agent, or Firm*—Robert A. Westerlund; Steven M. Mitchell; Wanda K. Denson-Low

[57] ABSTRACT

A microstrip focal plane array antenna is disclosed which includes a planar dielectric board 18 having a first surface 22 and second surface 28. A second radiating element 30 is located on the second surface 28 of the dielectric board 18 and a first radiating element 12 is located on the first surface 22 of the dielectric board 18. Energy is coupled to the first radiating element 12 from the second radiating element 30 and is reradiated by the first radiating element 12.

In a specific embodiment, the second radiating element 30 is a resonator 30 at one end of a coplanar waveguide, 24, having longitudinal and traverse axes, 32 and 34 respectively. The first radiating element 12 is a microstrip patch 12 of conductive material, having longitudinal and traverse axes, 14 and 16 respectively. The microstrip patch 12 is aligned over the resonator 30 such that electromagnetic energy from the resonator 30 is reradiated as linearly polarized energy by the microstrip patch 12.

In an alternative embodiment, the microstrip patch 12 is aligned relative to the resonator 30 such that the longitudinal axis 32 of the microstrip patch 12 is at an angle of 45 degrees with respect to the longitudinal axis 32 of the resonator 30. This orientation, is effective to cause the patch 12 to radiate circularly polarized energy.

1 Claim, 3 Drawing Sheets

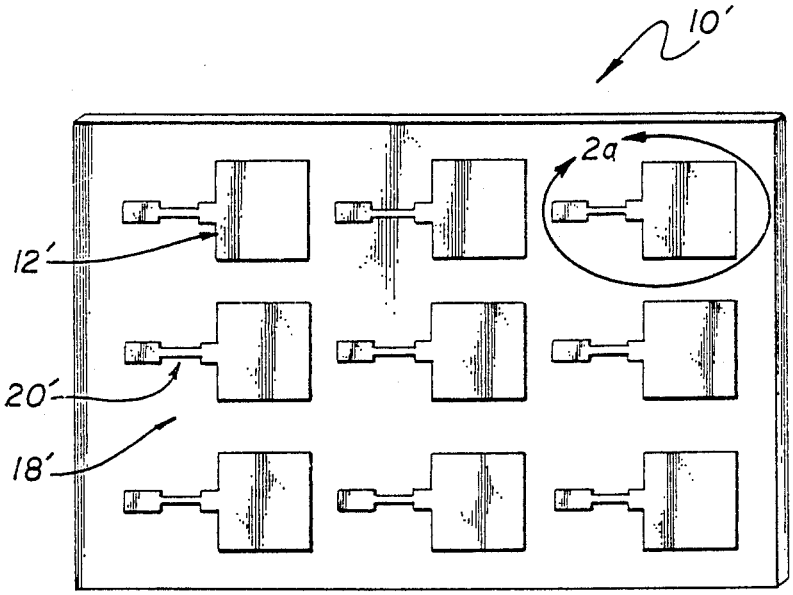
FIG. 1
(PRIOR ART)
FIG. 2(a)
(PRIOR ART)
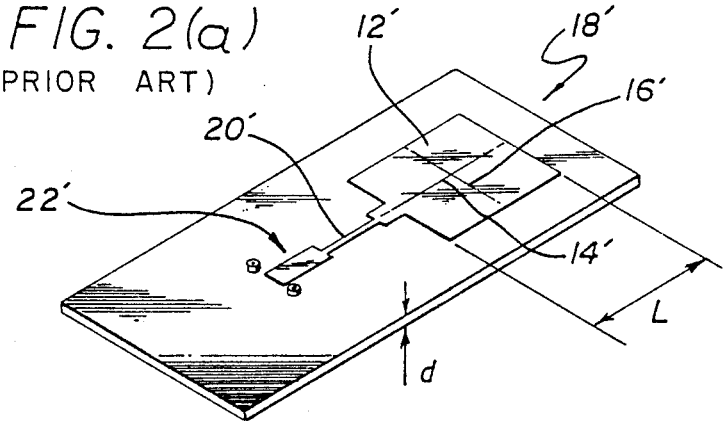

FIG. 2(b)
( PRIOR ART )
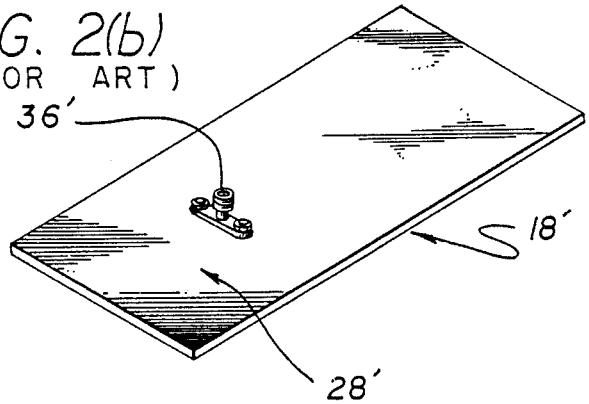
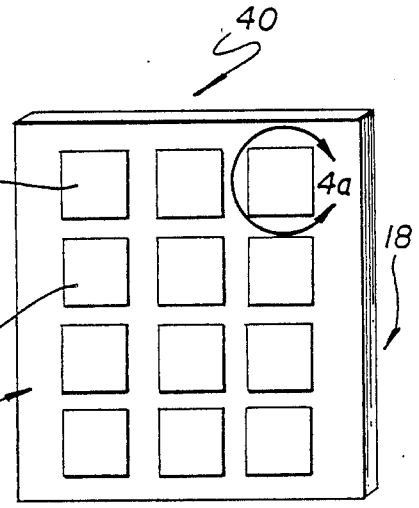
FIG. 3(a)
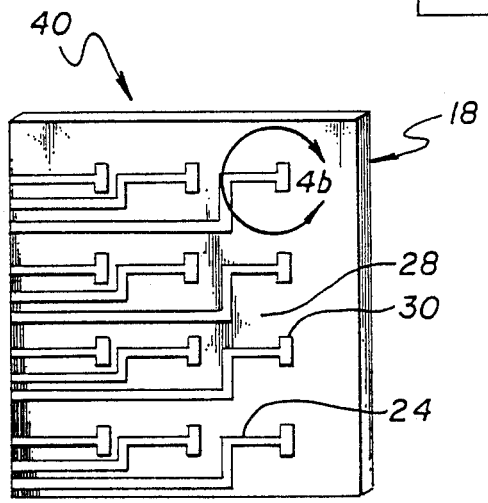
FIG. 3(b)

FIG. 4(a)
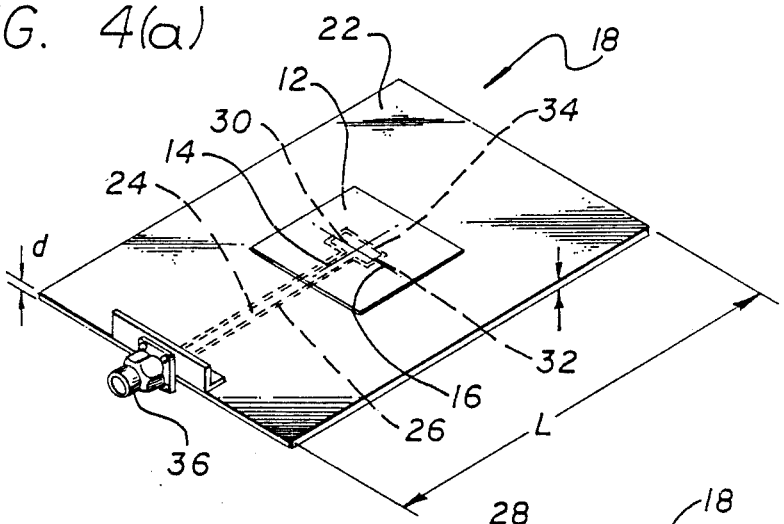
FIG. 4(b)
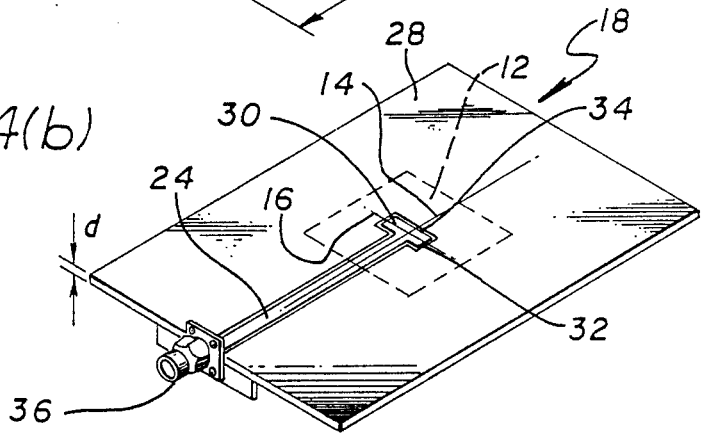
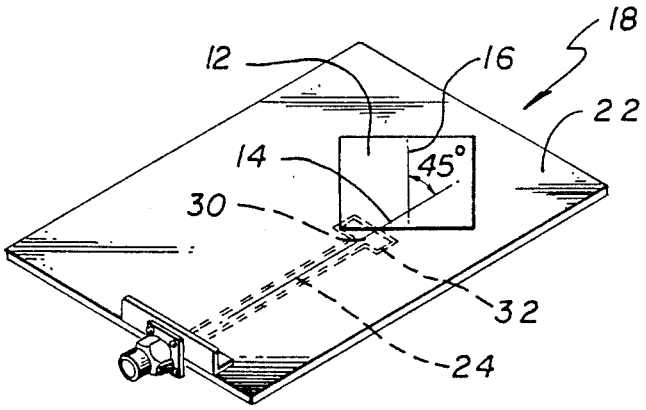
FIG. 5

FOCAL PLANE ARRAY ANTENNA

BACKGROUND OF THE INVENTION

1. Field of the Invention

The present invention relates to antennas. More specifically the present invention relates to focal plane array antennas.

While the invention is described herein with reference to a particular embodiment for an illustrative application, it is understood that the invention is not limited thereto. Those having ordinary skill in the art and access to the teaching provided herein will recognize additional modifications, applications and embodiments within the scope thereof.

2. Description of the Related Art

Focal plane array antennas include an array of radiating elements which may be individually excited to provide an electronically steered beam. Microstrip patch antenna arrays provide a focal plane array antenna of lightweight construction which is particularly useful for spacecraft applications. A conventional microstrip patch antenna includes an array of conductive patch radiating elements mounted on a dielectric substrate. The radiating elements are typically fed by a transmission line. The transmission line typically runs on the element surface of the dielectric substrate and is solder connected to an input connector. The input connector extends through the dielectric substrate and facilitates communication with associated circuitry.

Unfortunately, conventional microstrip patch focal plane array antennas have certain limitations. First, the surface mounted transmission line, precludes the close spacing of the radiating elements. The inability to closely space the radiating elements increases the weight and cost of the antenna, making it less desirable for certain applications, e.g. spacecraft.

Secondly, the direct electrical connection of the radiating elements to the processing circuits provides a conductor for thermal energy. The microstrip radiators act as solar heat collectors and generate a thermal load which may be communicated to the somewhat sensitive processing circuits. Thus, the cost associated with conventional patch antennas is typically increased by the need for thermal protection to guard against such damage.

The article "Aperture Coupled Patch Antennas and Arrays" by Daniel H. Schaubert and David M. Pozar, published by the Department of Electrical Engineering and Computer Engineering University of Massachusetts discloses methods of fabrication to improve performance and reduce the cost per element in large microstrip patch antenna arrays. The technique disclosed involves the use of aperture coupled patch radiators for focal plane array antennas. The aperture coupled patch radiator consists of a three layer network: a feed substrate, a ground plane with an aperture, and a microstrip patch located on an antenna substrate. As energy is coupled to the microstrip feedline, it is directed towards the ground plane. The coupled energy is received by the patch radiator through an electrically small aperture in the ground plane. The energy is then reradiated by the microstrip patch radiator. Electrical connections are supposedly not required and performance is ostensibly insensitive to misalignment of the two circuits. However, this coupling approach requires an additional substrate board, which increases the weight and cost per unit of the focal plane array antenna.

There is therefore a need in the art for a wide bandwidth microstrip patch antenna array having radiating elements closely spaced and thermally isolated from associated electronics.

SUMMARY OF THE INVENTION

The need in the art is substantially addressed by the focal plane array antenna of the present invention which includes a planar dielectric board having first and second planar surfaces. A first radiating element is located on the first surface of the dielectric board and a second radiating element is located on the second surface of the dielectric board. Energy is coupled to the first radiating element from the second radiating element and is reradiated by the first radiating element.

In a specific embodiment, the second radiating element is a loop antenna including a resonator in the shape of a rectangular loop at one end of a coplanar waveguide having longitudinal and traverse axes. In the specific embodiment, the first radiating element is aligned with the resonator such that electromagnetic energy from the resonator is received by the patch and reradiated as linearly polarized energy therefrom. In an alternative embodiment, the patch is aligned relative to the resonator such that the longitudinal axis of the patch is at an angle of 45 degrees with respect to the longitudinal axis of the resonator. In the alternative embodiment, the patch reradiates circularly polarized energy.

The present invention provides a patch antenna design which affords a close packing density of the radiating elements. Further, as the patch is thermally isolated from the associated electronic components, the specter of thermal damage to the processing electronics is mitigated. In a space application, the feed lines from each patch are protected, by the dielectric board, against direct solar radiation.

BRIEF DESCRIPTION OF THE DRAWINGS

FIG. 1 shows a front perspective view of a conventional microstrip focal plane array antenna.

FIG. 2(*a*) is a perspective view of the front surface of an individual microstrip patch radiating element of a conventional microstrip focal plane array antenna.

FIG. 2(*b*) is a perspective view of the rear surface of an individual microstrip patch radiating element of a conventional microstrip focal plane array antenna.

FIG. 3(*a*) shows a perspective view of the front surface of a microstrip focal plane array antenna constructed in accordance with the teachings of the present invention.

FIG. 3(*b*) is a perspective view of the rear surface of a microstrip focal plane array antenna constructed in accordance with the teachings of the present invention.

FIG. 4(*a*) shows a perspective view of the front surface of an individual microstrip patch radiating element constructed in accordance with the teachings of the present invention.

FIG. 4(*b*) is a perspective view of the rear surface of an individual microstrip patch radiating element constructed in accordance with the teachings of the present invention.

FIG. 5 is a perspective view of an alternative embodiment of an individual microstrip patch radiating element constructed in accordance with the teachings of the present invention for circular polarization.

DESCRIPTION OF THE INVENTION

FIG. 1 shows a front perspective view of a conventional microstrip focal plane array antenna 10' including an array of radiating elements or microstrip patches 12' on a dielectric substrate 18'.

The microstrip patch 12' is a patch of conductive material such as copper. The microstrip patch 12' has longitudinal axis 14' and traverse axis 16'. As shown more clearly in the magnified view of FIG. 2(*a*), each microstrip patch 12' is typically fed by a transmission line 20' photoetched on the front surface 22' of a dielectric substrate 18'. FIG. 2(*b*) shows an input connector 36' mounted on the rear surface 28' of the dielectric substrate and extending therethrough. The input connector 36' is solder connected to the transmission line 20'. The input connector 36' allows for communication between the microstrip patch 12' and associated processing electronics (not shown). In operation, energy is coupled to the microstrip patch 12' from the transmission line 20' and is reradiated by the microstrip patch 12'.

As is known in the art, the length 'L' of the radiating element 12' is a function of the wavelength at the operating frequency of the antenna and the dielectric constant of the substrate 18' as given by equation [1] below:

$$L \approx 0.49\lambda_d = 0.49\lambda_o/(\epsilon_r)^{\frac{1}{2}} \quad [1]$$

where

L = length of element, $\epsilon_r$ = relative dielectric constant, $\lambda_o$ = free-space wavelength and $\lambda_d$ = dielectric substrate wavelength.

The dielectric constant $\epsilon_r$ of the substrate is typically available from the manufacturer.

The bandwidth of the energy radiated by each patch is related to the operating frequency and the thickness of the substrate as given by equation [2] below:

$$BW = 4f^2d/32 \quad [2]$$

where

BW = bandwidth in megahertz for VSWR less than 2:1;

f = the operating frequency in gigahertz; and d = the thickness of substrate in inches.

As is known in the art, conventional microstrip focal plane array antennas 10' have several limitations. First the transmission line 20' associated with the microstrip focal plane array antenna 10', precludes the close spacing of the microstrip patch 12' and processing electronics on a single surface 22'. That is, the preferred spacing between processing electronics is at a distance of one-half to one free-space wavelength. The inability to closely pack the processing electronics may preclude the optimal spacing and otherwise increase the weight and cost per unit of a conventional focal plane array antenna 10'.

Secondly, in the conventional antenna 10', the microstrip patch 12' is directly connected to electronic circuitry. The microstrip, patch 12' acts as solar heat collector and generates a thermal load. This leads to a problem in that thermal energy may be communicated from the patch to electronic circuitry and cause considerable damage. The cost associated with conventional patch antennas is therefore typically increased by the need for thermal protection to prevent damage.

FIGS. 3(*a*) and 3(*b*) show a microstrip focal plane array antenna 40 constructed in accordance with the teachings of the present invention. As shown in the front view of FIG. 3(*a*) and as discussed more fully below, the antenna 40 includes an array of first radiating elements or microstrip patches 12 on a front surface 22 of a dielectric substrate 18.

FIG. 3(*b*) is a rear view of the antenna 40 showing an array of coplanar waveguides 24. Each waveguide 24 is terminated by a second radiating element or resonator 30. In a transmit mode, electromagnetic energy radiates from the resonator 30 through the dielectric board 18 to a corresponding microstrip patch 12. Energy received by the microstrip patch 12 is reradiated into space. In the receive mode, energy is received by a patch 12 and reradiated to a corresponding resonator 30. In any event, there is no direct electrical connection between the microstrip patches 12 and the coplanar waveguides 24. A close packing of the microstrip patches 12 is permitted by the elimination of the transmission line 20' of the conventional focal plane array antenna 10'. Also, the arrangement is effective to mitigate the conduction of thermal energy from the radiating elements 12 to processing circuitry.

FIG. 4(*a*) is a perspective frontal fragmentary view of an individual microstrip patch radiating element 12 of the antenna 40 constructed in accordance with the teachings of the present invention. The dielectric board 18 may be made of Duroid, or any other suitable material exhibiting a low loss quality. The board has a conductive coating on front and rear surfaces 22 and 28 respectively.

The first radiating element 12 is photoetched on the front surface 22 of the dielectric board 18 by a conventional etching process. Each front radiating element 12 is a square or rectangular patch of conductive material (e.g. copper). The patch 12 has longitudinal and traverse axes 14 and 16, respectively. The length 'L' of the microstrip patch 12 is a function of a wavelength at the operating frequency of the antenna 40 and the dielectric constant $\epsilon_r$ of the substrate 18 as given by equation [1] above. The thickness 'd' of the substrate is determined using equation [2] above.

In accordance with the teachings of the present invention, the microstrip patch 12 is aligned with the second radiating element or resonator 30 shown in phantom in FIG. 4(*a*) such that the longitudinal axis 14 of the microstrip patch 12 is substantially parallel with the longitudinal axis 32 of the resonator 30. The microstrip patch 12 is aligned over the resonator 30 such that electromagnetic energy radiated from the resonator 30 is received by the microstrip patch 12 as shown in FIG. 4(*a*).

FIG. 4(*b*) shows a perspective view of the rear surface 28 of an individual microstrip patch radiating element 12 constructed in accordance with the teachings of the present invention. As shown, a coplanar waveguide 24 is located on the rear surface 28 of the dielectric board 18. The coplanar waveguide 24 is terminated by a resonator 30. The resonator 30 is a rectangular loop antenna having a longitudinal axis 32. A groove 26 exists where copper has been etched off the board 18 to form a coplanar waveguide 24 and resonator 30. The opposite end of the coplanar waveguide 24 is connected to the input connector 36. In the illustrative embodiment of FIG. 4(*b*), the coplanar waveguide 24 and resonator 30 are photoetched onto the second surface 28 of the dielectric substrate 18 by conventional etching processes known to those skilled in the art. In operation, the coplanar waveguide 24 conducts energy to the resonator 30. The resonator 30 radiates the received energy through the dielectric board 18 to the microstrip patch 12. The microstrip patch 12 reradiates the electromagnetic energy into space.

In the illustrative embodiment of FIGS. 4(*a*) and 4(*b*), the arrangement of the microstrip patch 12 relative to the resonator 30 is effective to radiate linear polarized energy. FIG. 5 shows a perspective view of an alternative embodiment of an individual microstrip patch radiating element 12 constructed in accordance with the teachings of the present invention to radiate circular polarization energy. In keeping with the present invention, the coplanar waveguide 24 and the resonator 30 are photoetched on the second surface 28 of the dielectric board 18. The microstrip patch 12 is located on the front surface 22 of the dielectric board 18 and is aligned over the resonator 30 such that electromagnetic energy coupled from the resonator 30 is at least partially received by the patch 12. That is, the patch 12 is aligned relative to the resonator 30 such that the longitudinal axis 14 of the patch 12 is at an angle of 45 degrees with respect to the longitudinal axis 32 of the resonator 30. The microstrip patch radiating element 12 illustrated in FIG. 5, receives energy from the resonator 30 and reradiates the energy in the circular polarized mode.

In accordance to the teachings of the present invention a method has been disclosed for radiating energy. That is, a coplanar wavequide 24 conducts energy to a resonator 30 which couples electromagnetic energy through the dielectric substrate 18 to a microstrip patch 12. The patch 12 receives the electromagnetic energy and reradiates same in a linear or circular polarized mode.

While the present invention has been described herein with reference to an illustrative embodiment and a particular application it is understood that the invention is not limited thereto. Those having ordinary skill in the art and access to the teachings of the present invention will recognize additional modifications and applications within the scope thereof. The invention is not limited to the shape of the microstrip patches 12, the shape or length of the resonator 30. Nor is the invention limited to a one-to-one relationship between the microstrip patches 12 and the resonators 30. Multiple arrays of resonators 30 may be deposited on a single surface which may be selectively activated to provide both linear and circular polarized output beams from an array of microstrip patches 12 without departing from the scope of the present teachings. It is therefore intended by the appended claims to cover any and all such modifications, applications and embodiments.

Accordingly,

What is claimed is:

1. An antenna element, comprising:

a planar dielectric board having first and second planar surfaces;

a microstrip patch having longitudinal and transverse axes disposed on said first planar surface of said dielectric board for receiving and radiating electromagnetic energy;

a conductive layer mounted upon said second planar surface of said dielectric board to provide a ground plane;

a resonator having longitudinal and transverse axes disposed on said second planar surface of said dielectric board for electromagnetically coupling energy to said microstrip patch;

a coplanar waveguide disposed on said second planar surface of said dielectric board for feeding said electromagnetic energy to said resonator; and, wherein said microstrip patch is aligned relative to said resonator such that said longitudinal axis of said microstrip patch is disposed at an angle of approximately 45 degrees with respect to said longitudinal axis of said resonator.

* * * * *